United States Patent [19]

Fukui et al.

[11] Patent Number: 4,785,295

[45] Date of Patent: Nov. 15, 1988

[54] OPTICAL MEDIA MONITORING DEVICE

[75] Inventors: Tsutomu Fukui; Shin-ichi Suto; Kazutoshi Chiba, all of Tokyo, Japan

[73] Assignee: Oki Electric Industry Co., Ltd., Tokyo, Japan

[21] Appl. No.: 17,209

[22] Filed: Feb. 20, 1987

[30] Foreign Application Priority Data

Feb. 27, 1986 [JP] Japan ..... 61-40458
Jul. 15, 1986 [JP] Japan ..... 61-164731

[51] Int. Cl.[4] ..... G08B 21/00

[52] U.S. Cl. ..... 340/679; 340/514; 356/438

[58] Field of Search ..... 340/679, 514, 627, 674–675; 356/438–439, 338; 250/223 R, 564–565, 573, 577, 571, 561; 271/258, 263

[56] References Cited

U.S. PATENT DOCUMENTS 4,097,732 6/1978 Krause et al. ..... 250/205
4,363,032 12/1982 Kimoto ..... 340/679
4,670,647 6/1987 Hubble, III et al. ..... 250/223 R X

FOREIGN PATENT DOCUMENTS 1206654 1/1986 U.S.S.R. ..... 356/438

*Primary Examiner*—Glen R. Swann, III
*Assistant Examiner*—Thomas J. Mullen, Jr.
*Attorney, Agent, or Firm*—Spencer & Frank

[57] ABSTRACT

In an optical media monitoring device that detects presence of light-interrupting media between a photoemitter component and a photoreceptor component provided to operate in cooperation with each other, the photoemitter component is driven at a variable level of light emission, and a comparator compares the output of the photoreceptor component with a reference signal which is also variable. The driving means is controlled to cause the photoemitter component to emit a level of light lower than normally used for media detection. Dust degradation of the sensor is determined by checking, in a state of no media present and the reduced light emission of the photoemitter component, whether the output of the photoreceptor component is greater than the reference signal level.

12 Claims, 11 Drawing Sheets

OPTICAL MEDIA MONITORING DEVICE

BACKGROUND OF THE INVENTION

This invention relates to an optical media monitoring device having an optical sensor used in a machine that handles paper and other media to determine the presence or absence of the media. Specifically, it relates to an improvement for detecting degradation of the sensor by dust and adjusting the sensor's sensitivity.

Machines that handle paper and other media customarily detect the presence or absence of media in the machine and the passage of media through the machine by means of optical sensors consisting, for example, of a photoemitter such as a light-emitting diode and a photoreceptor such as a phototransistor. The presence of media between these two components alters the amount of light transmitted, thereby altering the output voltage of the phototransistor. Such an optical sensor tends to accumulate dust during use. The sources of the dust are the ambient air inside the machine and the media itself. The effect of the dust is to degrade the transmittance of light between the light-emitting diode and the phototransistor. It is desirable that such dust degradation be detected by a quick test performable when there is no media present between the light-emitting diode and phototransistor. One such test is the "dust check" performed as follows while the machine is idle: the drive current of the light-emitting diode is limited to reduce the intensity of light emitted; dust degradation is detected if the resulting output voltage of the phototransistor is above a certain level. Another method is called the auto-slice method: the drive current of the light-emitting diode is held fixed, and the reference signal level ("slice level") used to determine whether the media is present or absent is switched according to variations in the output voltage of the phototransistor.

A block diagram of the equipment for the conventional dust check is shown in FIG. 1. The equipment includes a driver circuit 2 that can switch the intensity of the light emitted by the light-emitting diode (LED) 3. The drive circuit 2 comprises two open-collector amplifier stages DRV1 and DRV2, two transistors TR1 and TR2, and two current-limiting resistors R1 and R2 connected to two signals A and B from the sensor controller circuit 1. Signal A produces the normal light intensity; signal B produces the intensity required for the dust check.

When the sensor controller 1 generates the normal-intensity signal A, the transistor TR1 turns on and a current $I_1$ limited by the current limiting resistor R1 flows to the LED 3. When the dust-check signal B is generated a current $I_2$ flows to the LED 3. The intensity of light emitted by the LED 3 is proportional to the drive current, and $I_2$ is set to be smaller than $I_1$. If the resistance R2 is set to produce the same intensity of received light as when the sensor is degraded by dust, the emitter voltage from the phototransistor 4 can be compared with a reference voltage $V_{ref}$ in a comparator 5 to produce an on/off signal that indicates whether the sensor is degraded by dust.

This dust check is capable of detecting dust degradation, but it does not enable the sensor to adapt to the degradation so that the machine can continue operating. When dust degradation is detected, the machine must be stopped. In addition, since the slice level $V_{ref}$ is fixed, the operating margin left in the state of absence of media is reduced, as can be seen by comparing the output voltage from the phototransistor 4 with the slice level $V_{ref}$ in FIG. 2, where M1 is the margin with no media present before dust degradation, while M2 is the margin after dust degradation. In the partially dust-degraded state there is increased risk that the sensor will erroneously detect media when none is present.

The auto-slice method is illustrated in FIG. 3. The configuration of the LED 3 and phototransistor 4 is similar to that already shown in FIG. 1, but the checking method is different. The intensity of the LED 3 is held fixed and the output voltage of the phototransistor 4 is converted by an analog-to-digital converter 6 to a sensor level signal C which is received and processed digitally by the sensor controller 1. The sensor controller 1 then adjusts the slice level as shown in FIG. 4. S1 in FIG. 4 is the slice level of the signal C in FIG. 3 for determining the presence or absence of media before dust degradation, and S2 is the slice level as changed in response to dust degradation.

By adjusting the slice level to compensate for dust the auto-slice method enables operation to continue despite a certain degree of dust degradation, but the analog-to-digital converter required is relatively expensive. In addition, in a machine with many optical sensors the sensor control circuit must process a large quantity of data, requiring special equipment such as a microprocessor and its peripheral circuits.

SUMMARY OF THE INVENTION

An object of this invention is to solve the problems described above.

Another object of this invention is to enable reliable detection and correction of dust degradation of optical sensors by a comparatively inexpensive circuit, and to provide optical media monitoring device with excellent adjustability.

According to the invention, there is provided an optical media monitoring device that detects presence of light-interrupting media between a sensor including a photoemitter component and a photoreceptor component provided to operate in cooperation with each other, the optical media monitoring device comprising:

means for driving the photoemitter component at a predetermined level of light emission;

a comparator receiving as one input thereof an output of the photoreceptor component;

means for generating a reference signal at a predetermined level, the reference signal being input to the other input to said comparator;

means for controlling said driving means to cause the photoemitter component to emit a level of light lower than the level normally used for media detection; and means for determining the degree of dust degradation of the sensor by checking, in a state of no media present and the light emission of the photoemitter component reduced by said controlling means, whether the output of the photoreceptor component is greater than the reference signal level.

DETAILED DESCRIPTION OF THE PREFERRED EMBODIMENTS

Embodiments of this invention are described below.

Figure 1:
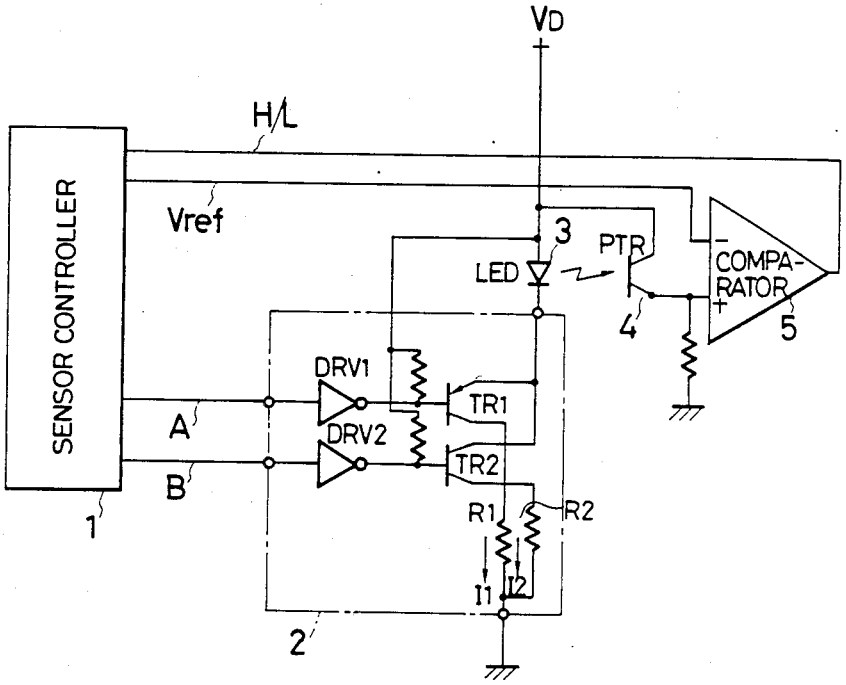
FIG. 1 PRIOR ART
FIG. 1 is a circuit diagram showing a prior art dust-checking-type media monitoring device.
Figure 2:
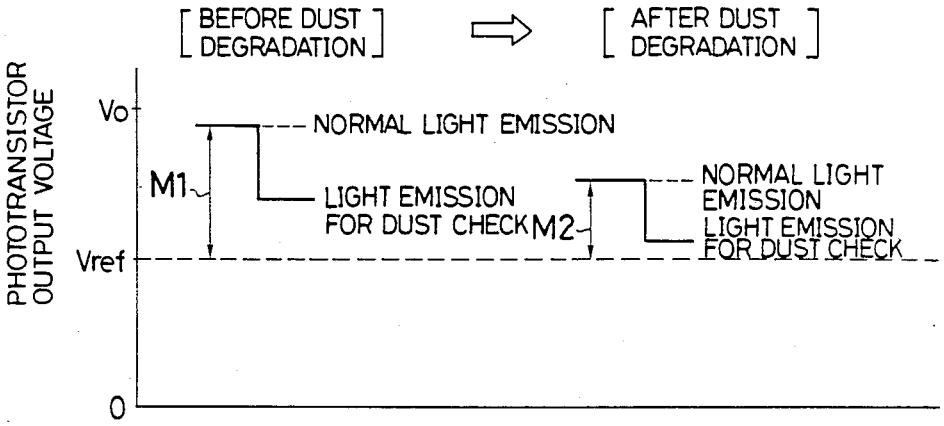
FIG. 2 PRIOR ART
FIG. 2 shows the operating output signal elves of the sensor in FIG. 1.
Figure 5:
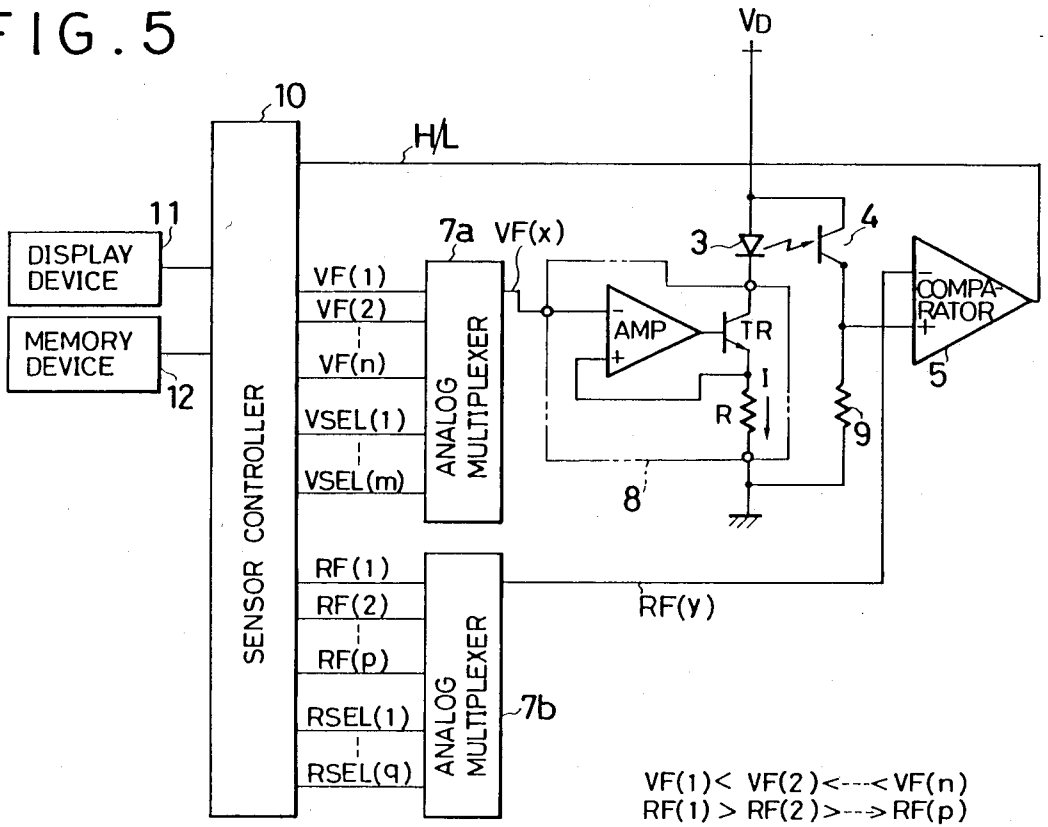
FIG. 5 is a circuit diagram showing an optical media monitoring device of an embodiment of the invention.

FIG. 5 is a schematic diagram showing the hardware configuration of an embodiment of this invention. The components in FIG. 5 that are identical or analogous to the components in FIG. 1 have the same identifying numbers. The sensor controller 10 produces current designating voltage signals VF(1) to VF(n) for designating the drive current, VF select signals VSEL(1) to VSEL(m) for selecting these current designating voltage signals, reference voltage signals RF(1) to RF(p) for the media detection circuit, and RF select signals RSEL(1) to RSEL(q) for selecting these reference voltage signals. The VF select signals VSEL(1) to VSEL(m) form a coded set of parallel signals, according which the analog multiplexer (AMPX) 7*a* selects one of the current designating signals VF(1) to VF(n). The selected circuit designating signal VF(x) is fed to the constant-current circuit 8. Similarly, the RF select signals RSEL(1) to RSEL(q) form a coded set of parallel signals, according to which the analog multiplexer (AMPX) 7*b* selects one of the reference voltage signals RF(1) to RF(p), and the selected reference voltage signal RF(y) is fed to the comparator 5. The levels of the current designating and reference voltage signals are arranged so that $VF(1)<VF(2)<\ldots<VF(n)$ and $RF(1)>RF(2)>\ldots>RF(p)$.

The constant-current circuit 8 comprises an amplifier AMP, a transistor TR, and a limiting resistor R. The current designating signal VF(x) is input to the inverting input terminal of the amplifier AMP, while the noninverting input terminal of this amplifier is connected to a node connected to the emitter of the transistor TR and the limiting resistor R. The base of the transistor TR is connected to the output terminal of the amplifier AMP, and the collector of the transistor TR is connected to the cathode of the LED 3. The anode of the LED 3 is connected to the supply voltage $V_D$. The feedback from the emitter of the transistor TR to the noninverting input of the amplifier AMP holds the current flowing through the transistor TR at the value designated by the current designating signal VF(x). The phototransistor 4 is located so as to receive the light from the LED 3. The collector of the phototransistor 4 is connected to the supply voltage $V_D$, while its emitter is connected to the noninverting input terminal of the comparator 5 and is also grounded through the resistor 9. The inverting input terminal of the comparator 5 receives the reference voltage signal RF(y) selected and output by the analog multiplexer 7*b*. The output of the comparator 5 is two-valued (high or low) signal. The value of which indicates whether or not the emitter output of the phototransistor 4 is greater than the reference voltage signal RF(y). The output of the comparator 5 is returned to the sensor controller 10.

In addition to performing the functions described above, the sensor controller 10 controls a display device 11 for displaying error messages and other information, and a memory device 12 that stores the current designating signal VF(x).

Figure 6:
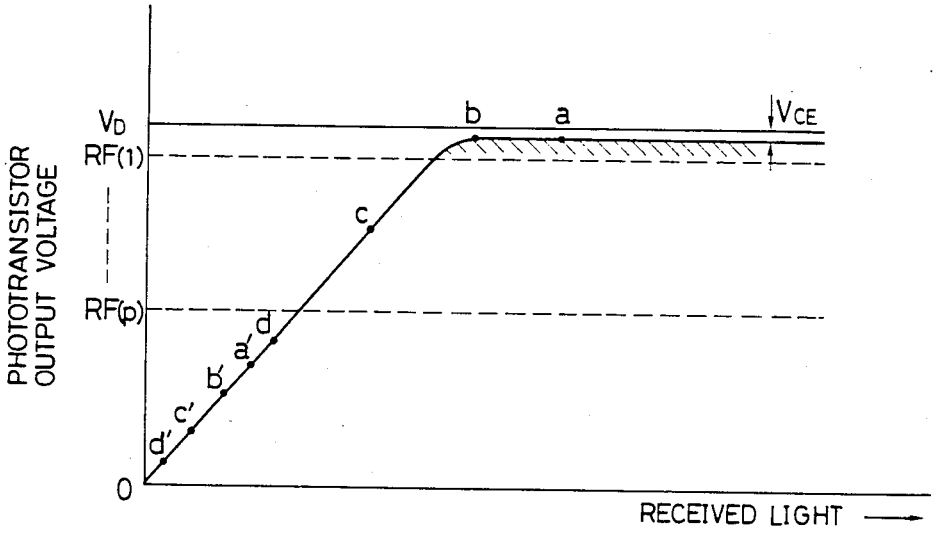
FIG. 6 shows the relation between the light intensity received by the phototransistor and its output voltage.

The output characteristic of the phototransistor 4 is shown qualitatively in FIG. 6. Due to the existence of a saturation voltage $V_{CE}$ between the emitter and collector of the phototransistor, the phototransistor output voltage does not reach $V_D$ even at large levels of received light. When there is no dust degradation of the optical sensor and no media present to interrupt the light between the LED 3 and phototransistor 4, the output voltage is at a. When there is no dust degradation but the light is interrupted by media, the output voltage is at a'. At progressively higher levels of dust degradation these outputs become b and b', c and c', and d and d'. If the slice level for media detection is set at RF(p), as dust degradation progresses and the outputs fall to b-b', then to c-c', the margin between the output in the media-absent state and the slice level gradually becomes insufficient. When dust degradation reaches the point that the outputs are at d and d', the sensor can no longer distinguish between the presence and absence of media.

In this embodiment, accordingly, the slice level is set to the value RF(1), which is only slightly lower than the saturation output $V_D-V_{CE}$ of the phototransistor 4, and the output voltage of the phototransistor 4 is tested with no media present to see if it is greater or less than the slice level RF(y); that is, if the output of the comparator 5 is high or low. The drive current of the LED 3 is progressively varied. If the output of the comparator 5 is high even at small amounts of drive current, dust degradation is absent or nearly absent and there is an adequate operating margin. If the output of the comparator 5 is low for small amounts of LED drive current but goes high when the drive current is increased slightly, a certain degree of dust degradation is recognized, a prealarm is generated, the drive current is set to a higher value, and operation is continued. If the output of the comparator 5 does not become high even when the drive current is increased, severe dust degradation is recognized and an alarm is generated.

Figure 7A:
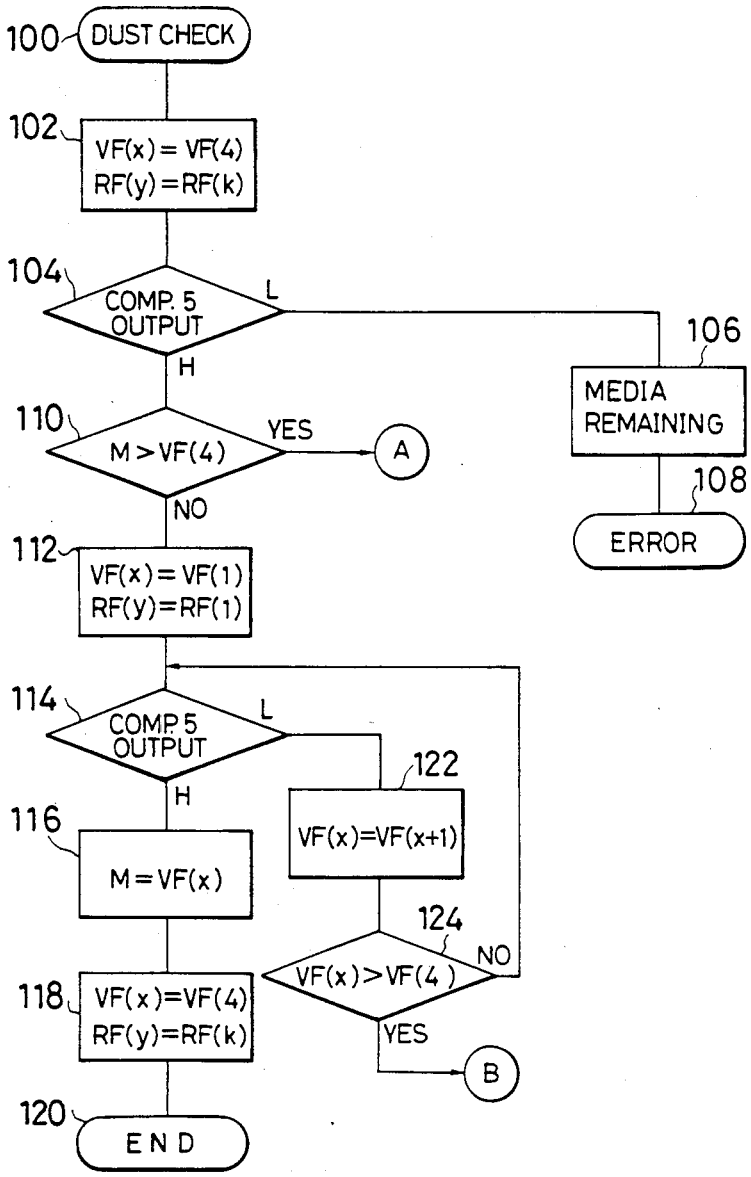
FIGS. 7A and 7B are flowcharts showing the operation of the sensor controller in FIG. 5.
Figure 7B:
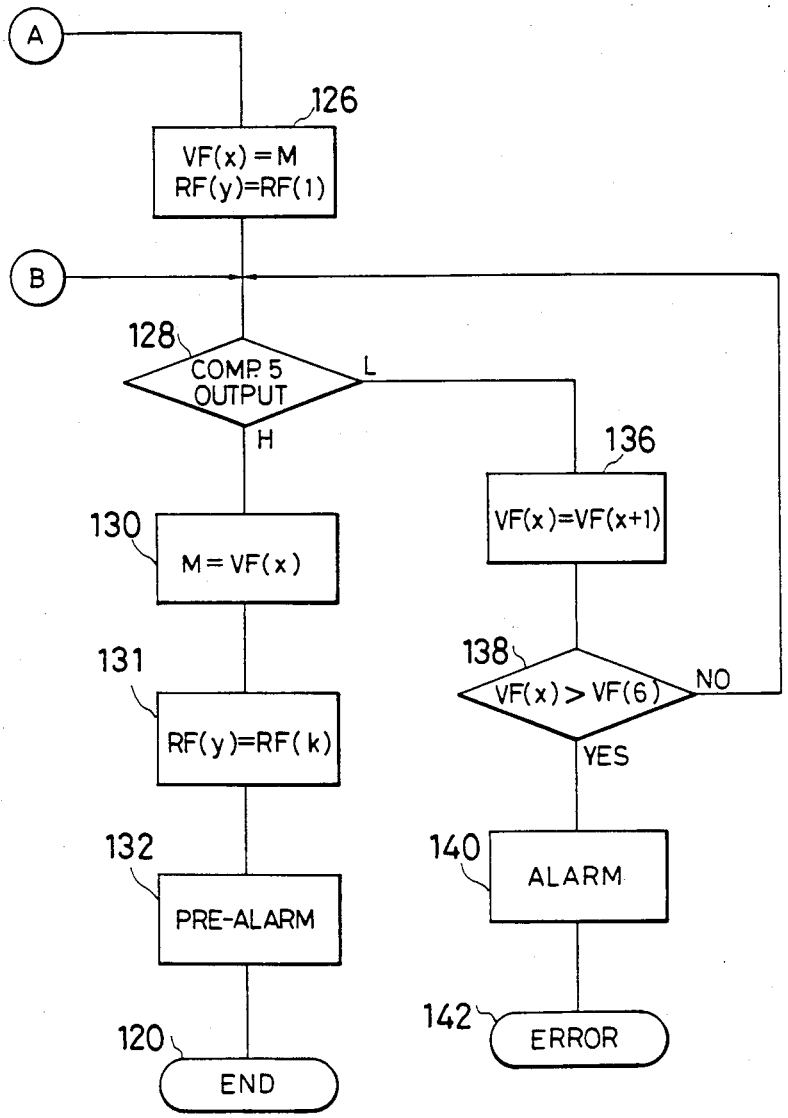

FIGS. 7A and 7B show the manner in which the sensor controller 10 executes the dust check and increases the light intensity as described above, on the assumptions that there are seven current designating signals VF(1) to VF(n) (i.e. the value of n in FIG. 5 is 7), that the current designating signal VF(x) selected in the standard state of the device for handling the media, e.g., paper currency (the state when the machine is newly installed) is VF(4), and that $RF(y)=RF(k)$, where $k<p$. In other words, the design values are VF(4) and RF(k).

The dust check routine is run after the operator manually ascertains that there is no media between the LED 3 and the phototransistor 4.

First, the standard settings are made by setting VF(x) to VF(4) and RF(y) to RF(k) in step 102, and the output of the comparator 5 is checked in step 104. If the output is low, indicating that the output of the phototransistor 4 is below the slice level, the conclusion (step 106) is that either there is severe dust degradation of media is still present in the machine (error in the mannal ascertainment), and the error handling (step 108) is performed. In the error handling the error is indicated on the display device 11. The action taken in response to the error indication is, for example, to remove the remaining media or to clean or replace the sensor.

If the output of the comparator 5 in step 104 is high, the next step (110) is to check whether the value M of the current designating signal VF(x) stored in the memory device 12 is greater than VF(4). The stored value M is the value selected by the previous dust check routine. In the step 100 and the following steps, the value of VF(x) is varied (steps 112, 122, 126, and 136) in a way that depends on the result of step 110 and the check of the output of the comparator 5 is repeated (steps 114 and 128), while RF(y) is maintained at the maximum value RF(1), the slice level nearest the saturation voltage.

If the result of the check on the relative values of M and VF(4) in step 110 is that M is equal to or less than VF(4), VF(x) is set to VF(1) in step 112, giving the minimum emitted light intensity, and the output of the comparator 5 is checked in step 114.

If the result is high, meaning that the output from the phototransistor 4 is greater, the current setting VF(x)=VF(1) is stored as the value of M in step 116, VF(x) and FR(y) are returned to the standard settings of VF(4) and RF(k) in step 118, and the routine ends (step 120).

If the result in step 114 is low, VF(x) is increased by one level in step 122 and step 114 is repeated. This process continues until VF(x) exceeds VF(4) (as checked in step 124). That is, in the range of VF(x) values not exceeding VF(4), VF(x) is increased one level at a time and the value that first causes a high output from the comparator 5 is stored as M in step 116, while the final value of VF(x) is left at VF(4) in step 118. In media-handling operations after this dust check routine, accordingly, the current designating signal used is VF(x)=VF(4). RF(y) is always set to RF(k).

If the output of the comparator 5 checked in step 114 is still low when VF(x)=VF(4), VF(x) is increased to VF(5) which is greater than VF(4). A "yes" result in step 124 then sends the routine to step 128 in FIG. 7B.

If M is greater than VF(4) in step 110, VF(x) is set to the value of M in step 126, then the routine proceeds to step 128.

Step 128 checks the output of the comparator 5. If the output is high, the current VF(x) is stored as the value M and a pre-alarm is generated on the display device 11 (step 132) to indicate that the sensor is somewhat dust-degraded.

If the output in step 128 is low, VF(x) is raised one level in step 136, then step 128 is repeated. This process continues until VF(x) exceeds VF(6), as checked in step 138. That is, in the range of VF(x) values greater than VF(4) and less than or equal to VF(6), VF(x) is increased one level at a time and the first VF(x) level at which the output of the comparator 5 becomes high is stored as M (step 130), this level also being left as the final VF(x) level. As a result, in the media-handling operation after this dust check routine, a VF(x) greater than VF(4), i. e., either VF(5) or VF(6), is used as the current designating signal. RF(y) remains set at RF(k) in step 131, the same as when VF(x)≦VF(4).

If the output of the comparator 5 checked in step 138 is still low when VF(x)=VF(6), VF(x) is increased to VF(7) which is greater than VF(6). A "yes" result in step 138 then sends the routine to step 140 in FIG. 7B, generating an alarm. This alarm indicates severe dust degradation: even when the LED drive current is increased to VF(6) the amount of light received by the phototransistor 4 is still too small. A message such as "Sensor dust error" is displayed on the display device 11.

To summarize this embodiment in the state with no media present, the slice level is raised to a value near the saturation level and the LED drive current needed to raise the output of the phototransistor 4 above this slice level is determined. If the necessary current VF(x) is small—equal to or less than VF(4)—the value of VF(x) is only stored as M. If a fairly large current is necessary—VF(5) or VF(6)—a pre-alarm is generated to indicate a moderate degree of dust degradation, and operation is continued using an elevated LED drive current. If the necessary current is very large—greater than VF(6)—, an alarm is given to warn of severe dust degradation and request cleaning or other corrective action, and operation is halted.

Figure 3:
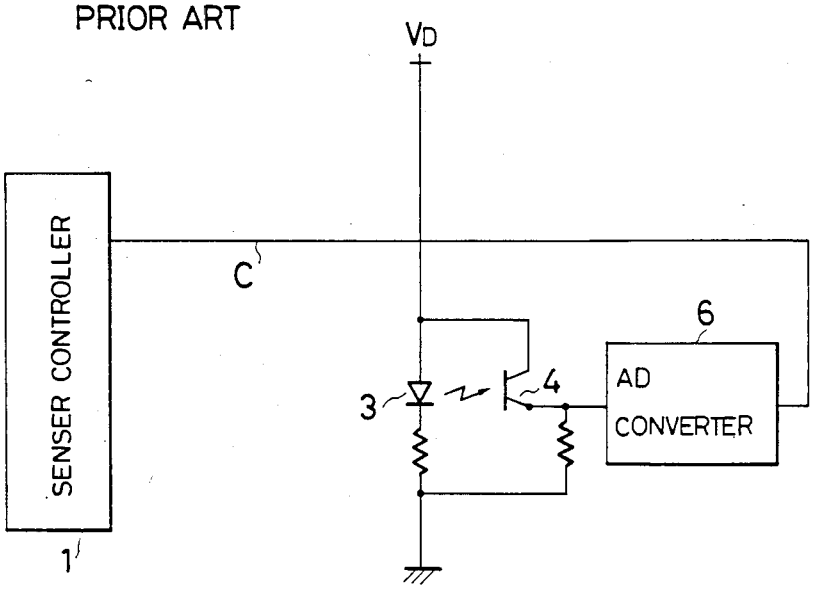
FIG. 3 PRIOR ART
FIG. 3 is a circuit diagram showing a prior art auto-slice-type media monitoring device.
Figure 4:
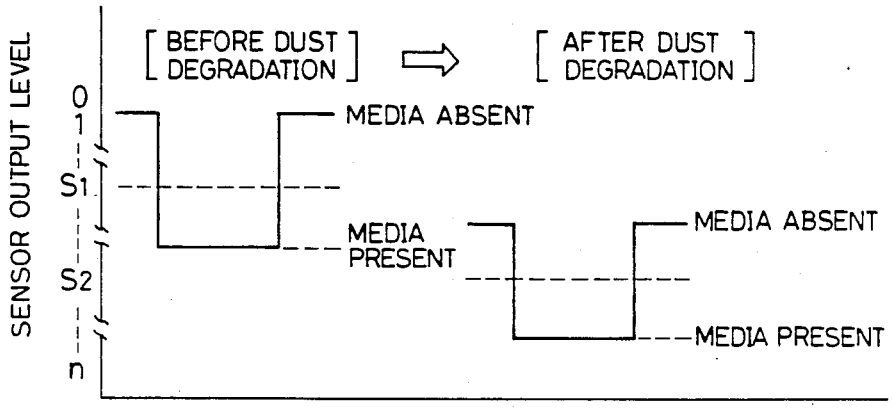
FIG. 4 PRIOR ART
FIG. 4 shows the output signal levels of the sensor in FIG. 3.

In this embodiment, the degree of dust degradation of the sensor can be found accurately by reducing the intensity of the LED 3 and testing the output signal of the phototransistor 4 with a slice level set near the output saturation signal voltage of the phototransistor 4. If dust degradation is detected, the intensity of the LED 3 is increased to compensate for the dust degradation. In addition, the circuit configuration is simple and inexpensive, not requiring costly AD and DA converter components as used in the prior art in FIG. 3.

In the explanation of the embodiment above, the photoemitter and photoreceptor components were a light-emitting diode and a phototransistor, but any other types of devices with similar functions may be used instead. The photoreceptor, for example, may be a photodiode, if a voltage-to-current conversion circuit is provided between the photoreceptor and the comparator.

Figure 8:
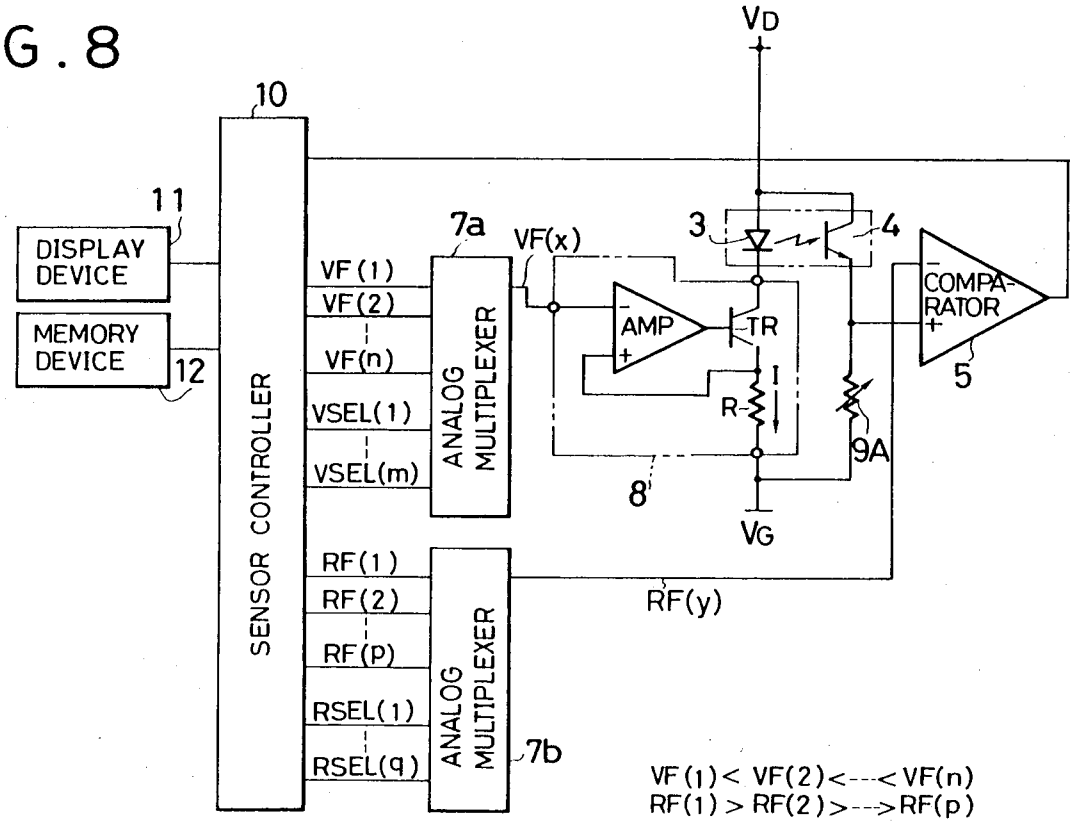
FIG. 8 is a circuit diagram showing a second embodiment of this invention.

FIG. 8 shows another embodiment of this invention.

The device of this embodiment is similar to that in FIG. 5 except that the resistor 9 is replaced by a variable resistor 9A. The variable resistor 9A provides a convenient means of adjusting the sensitivity of the sensor. Sensor sensitivity (including the emitted light intensity for a given drive current and the sensitivity and gain of the photoreceptor) may vary due to nonuniformity of manufacture and to aging changes. The sensitivity can be adjusted by varying the resistance of the variable resistor 9A.

The same sensor control circuit can be used in FIG. 8 as in FIG. 5. However, it is desirable that the control circuit have an additional function like that shown in FIG. 9.

The purpose of this additional function is to check that the output of the comparator 5 is low in the presence of media when the LED 3 has the normal intensity value. As stated previously, it is necessary to perform this type of test when no media is actually present in the machine (when the machine is not operating). This is done by simulating the presence of media: the intensity of light emitted by the LED 3 is reduced so as to provide the phototransistor 4 with the amount of light it would receive with media present if the LED 3 were operating at its normal intensity and there were no dust degradation. Then the output of the comparator 5 is checked to see if it is low. If it is now low, the variable resistor 9A is reduced until low output is obtained.

Figure 10:
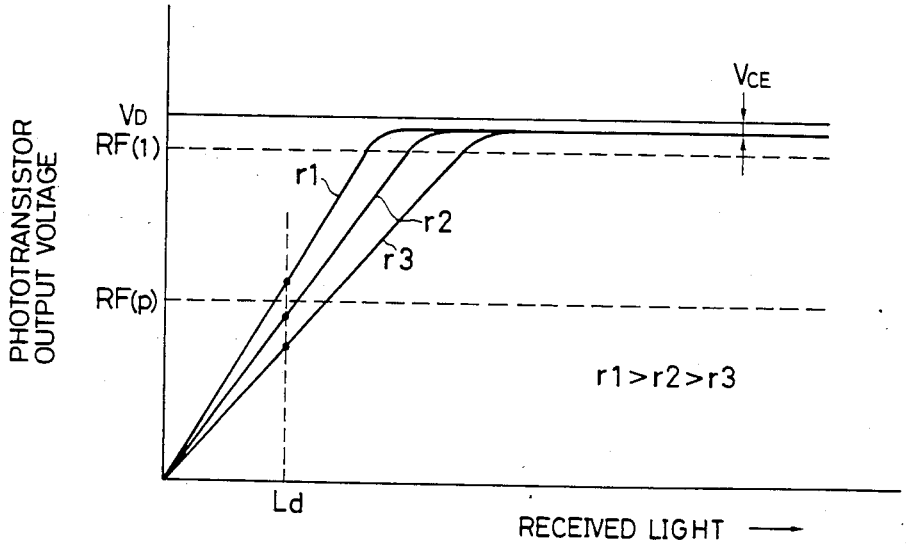
FIG. 10 shows the relation between the light intensity received by the phototransistor and its output voltage with the resistance value of the variable resistor 10 as a parameter.

FIG. 10 shows the relation between the light received by the phototransistor 4 and its output voltage for various resistance values of the variable resistor 9A. For a given intensity of light received, the output voltage of the phototransistor 4 varies in response to the resistance value of the resistor 9A. In the media-present state as simulated by reducing the emission of the LED 3 (so that the received level of illumination is Ld), the output voltage of the phototransistor must be lower than the slice level RF(p). Of the three r values r1, r2, and r3 (r1 >r2 >r3), only r2 and r3 satisfy this requirement.

Figure 9:
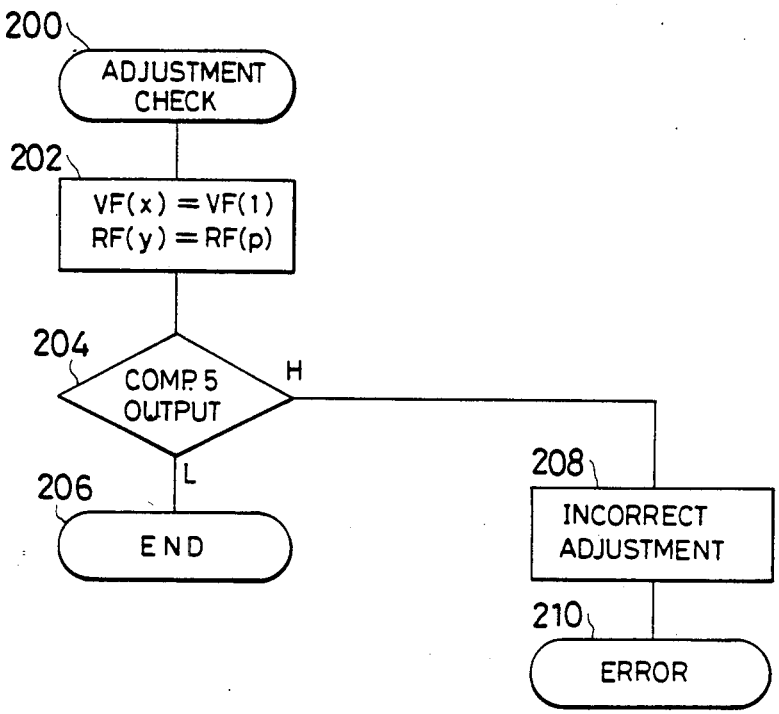
FIG. 9 is a flowchart showing the operation of the sensor controller in FIG. 8.

An explanation of the flowchart in FIG. 9 is given below.

After entry to the adjustment check routine (step 200), the first step (202) is to set the current designating signal VF(x) to VF(1) and the reference voltage signal RF(y) to RF(p). With no dust degradation and no media present, VF(1) provides the phototransistor 4 with the amount of light it would receive if the LED 3 were emitting at its normal level VF(4) and media were present. The output of the comparator 5 is checked in this condition in step 204. If the output is low (meaning that the output of the phototransistor is low), the sensor is determined to be correctly adjusted and the check ends (step 206). If the output is high, the sensor is determined to be incorrectly adjusted (step 208) and error handling is performed (step 210). That is, the variable resistor 9A is readjusted. An indicator lamp such as a visible-light-emitting diode, not shown in the figures, is provided in the sensor controller 10 to indicate the output state of the comparator 5. This indicator lamp can be monitored visually while the sensor sensitivity is being adjusted by means of the variable resistor 9.

Figure 11:
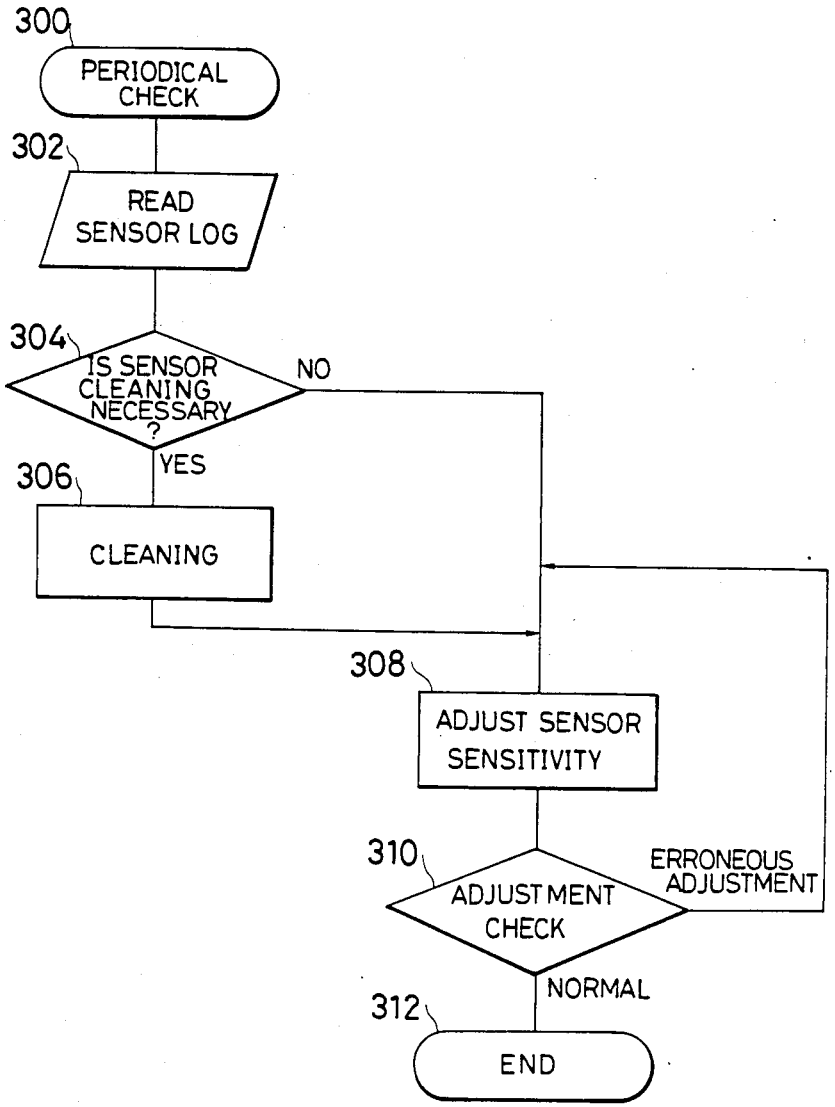
FIG. 11 is a flowchart showing the maintenance procedure.

FIG. 11 is a flowchart of the maintenance procedure. During periodic inspection (step 300), the serviceman reads out the sensor log (step 302), which consists of information input from the sensor and stored in the memory device 12. From this sensor log the serviceman determines the degree of dust degradation and decides whether it is necessary to clean the sensor (step 304). If the serviceman decides that the sensor does not require cleaning, he next adjusts the sensitivity of the phototransistor 4 (step 306). After this adjustment he makes the adjustment check described previously in FIG. 10 (step 308). If the result of the adjustment check is normal, the periodic inspection ends. If the check indicates incorrect adjustment, the serviceman returns to step 308 and readjusts the sensitivity of the phototransistor 4. If the serviceman decides that sensor cleaning is necessary in step 304, he cleans the sensor to remove the accumulated dust (step 306). After cleaning the sensor, the serviceman proceeds to step 308 and adjusts the sensitivity of the phototransistor 4.

To summarize the embodiment shown in FIGS. 8 to 11, with no media present in the sensor, the intensity of the LED 3 is reduced to simulate the presence of media and detect incorrect adjustment of the sensor sensitivity. Thus incorrect adjustment can be detected before the machine is operated. The time required for the maintenance and the workload of the serviceman are reduced.

This invention can be applied to any machine that requires media monitoring, including copiers, printers, paper currency handling machines and the like. It is particularly effective when the media is paper, which allows partial light transmission and generates considerable amount of dust.

What is claimed is:

1. An optical media monitoring device that detects presence of light-interrupting media between photoemitter component and a photoreceptor component of a sensor provided to operate in cooperation with each other, the optical media monitoring device comprising:
   - means for driving the photoemitter component at a predetermined level of light emission;
   - a comparator receiving as one input thereof an output of the photoreceptor component;
   - means for generating a reference signal at a predetermined level, the reference signal being input to the other input to said comparator;
   - means for controlling said driving means to cause the photoemitter component to emit a level of light lower than a level normally used for media detection; and
   - means for determining the degree of dust degradation of the sensor by checking, in a state of no media present and the light emission of the photoemitter component reduced by said controlling means, whether the output of the photoreceptor component is greater than the reference signal level.

2. A device according to claim 1 further comprising means for controlling said reference signal generating means to obtain a reference signal level higher than a level normally used for media detection, wherein said determining means makes the above determination in a state of the light emission being reduced and the reference signal increased.

3. A device according to claim 2 wherein said means for controlling said reference signal generating means sets said reference signal at a level near the output saturation level of the photoreceptor component, and said means for controlling said drive means sets said light emission of the photoemitter component such that, in the state of maximum allowable dust degradation, the output signal from the photoreceptor component exceeds by a predetermined margin said reference signal.

4. A device according to claim 3 further comprising means for controlling said driving means so as to increase the light emission of the photoemitter component if the output of the photoreceptor component is less than the reference signal.

5. A device according to claim 1 wherein said means for controlling said drive means sets the light emission of the photoemitter component at such a level that the amount of light transmitted from the photoemitter component with the reduced light emission to the photoreceptor component is approximately equal to the amount of light that the photoreceptor component would receive with media present if the sensor were not dust-degraded and if the photoemitter component were emitting light at the level normally used in media detection.

6. A device according to claim 5 further comprising means for adjusting the level of the output signal of the photoreceptor component.

7. A device according to claim 6 further comprising means for generating a signal requesting adjustment of said adjusting means if the output signal from the photoreceptor component with the reduced light emission of the photoemitter component is less than the reference signal normally used for media detection.

8. A device according to claim 1 wherein said driving means is capable of varying the light emission in a series of steps.

9. A device according to claim 8 wherein said driving means comprises a constant-current circuit connected in series with the photoemitter component and a current-setting circuit that gives a current set for said constant-current circuit.

10. A device according to claim 9 wherein said current-setting circuit comprises an analog multiplexer that inputs signals having different levels and selectively outputs one of these signals, and there is further provided means for controlling the analog multiplexer as to the selection of the signals.

11. A device according to claim 1 wherein said reference signal generating means is capable of varying said reference signal in a series of steps.

12. A device according to claim 11 wherein said reference signal generating means is an analog multiplexer that inputs signals having different levels and selectively outputs one of these signals, and there is further provided means for controlling the analog multiplexer as to the selection of the signals.

* * * * *